United States Patent [19]

Vallomy

[11] Patent Number: 4,543,124

[45] Date of Patent: Sep. 24, 1985

[54] APPARATUS FOR CONTINUOUS STEELMAKING

[75] Inventor: John A. Vallomy, Charlotte, N.C.

[73] Assignee: Intersteel Technology, Inc., Matthews, N.C.

[21] Appl. No.: 636,944

[22] Filed: Aug. 2, 1984

[51] Int. Cl.[4] ..... C21C 7/00; H05B 7/18

[52] U.S. Cl. ..... 75/46; 75/10 R; 75/12; 373/60; 373/109

[58] Field of Search ..... 75/10–12, 75/46, 44 S; 266/128; 373/60, 109

[56] References Cited

U.S. PATENT DOCUMENTS

| | | | |
|---|---|---|---|
| 3,022,157 | 2/1962 | Huntington | 75/46 |
| 3,634,065 | 1/1972 | Worner | 75/46 |
| 4,457,777 | 7/1984 | MacGregor | 75/46 |

*Primary Examiner*—Peter D. Rosenberg
*Attorney, Agent, or Firm*—Ralph H. Dougherty

[57] ABSTRACT

Apparatus for the continuous making of steel in an electric steelmaking furnace, having a charge material preheater, continuous charging means, and means for removing refined steel without removing the furnace electrodes from operation, wherein charging and tapping are accomplished while maintaining full electric power, and allowing for good control over both product quality and product chemistry.

14 Claims, 3 Drawing Figures

APPARATUS FOR CONTINUOUS STEELMAKING

BACKGROUND OF THE INVENTION

This invention relates to the continuous melting of a metallic charge to form a molten steel product. The process is particularly advantageous in those regions where there is a concentration of production of, or ready availability of scrap and/or direct reduced iron (DRI), and where electric energy is both available and economical.

Heretofore, the operation of an electric arc steelmaking furnace has been an intermittent operation, wherein the sequence followed is: charging of steel scrap and/or direct reduced iron, pig iron, slag formers and alloying elements; ignition or establishment of an electric arc between the electrodes in the furnace to create melting conditions for melting the charge and forming a molten metal bath covered by a molten slag; refining for a period of time during which the molten metal portion of the bath is refined to form steel having a desired composition and quality; and periodically raising the electrodes to remove them from contact with the bath and interference with the tapping procedure; and then tapping the molten metal. In addition, slag can be removed by a slagging, or slag-off, operation as required.

Although this invention is shown and described in connection with an electric arc steelmaking furnace, it will be readily apparent that any electric powered steelmaking furnace including but without limitation, plasma furnaces and induction furnaces could be substituted for the electric arc steelmaking furnace with like results.

There is currently a steelmaking practice known as "continuous charging" or "continuous melting", but these practices refer to a charging practice in which charge materials are fed to a furnace during the charging, melting and refining periods, then charging is interrupted and power input is interrupted for the tapping procedure. It has been found that an electric steelmaking furnace can be operated continuously without interruption of charging or power input for the tapping procedure by the taking the following steps in the steelmaking process.

First, scrap must be prepared by shredding or shearing it to a suitable size. The scrap is preferably segregated for quality control. As received, the scrap is segregated into desired classifications, preferably depending on contamination by tramp elements sulphur and phosphorus. Segregated scrap is shredded or sheared and stored for use. By maintaining a stock or shredded or sheared raw material, continuous operation of the process is assured during periods of shredder or shear down-time.

Direct reduced iron is normally prepared in the form of lumps or pellets, which are generally of a size of less than about one half inch diameter. Direct reduced iron briquets can also be used as feed material. Preferably such direct reduced iron is produced at a contiguous plant.

Scrap, direct reduced iron, slag formers and alloying materials are preheated and continuously fed to the electric arc furnace. A foaming slag practice is used, and the furnace is only partially tapped intermittently without removal of the electrodes, thus electrodes remain at full power during both continuous feeding, refining (which is continuous) and tapping (which is intermittent). Tapping is carried out by limited tilting of the furnace, generally not varying more than 15° from the vertical.

SUMMARY OF THE INVENTION

The present invention is a method for the continuous refining of steel, comprising the steps of preparing iron-bearing scrap for use in shredded, sheared or granular form; segregating the prepared scrap; preheating iron-bearing scrap, direct reduced iron, or a mixture thereof, and feeding the same to an electric powered steelmaking furnace for melting and refining therein; feeding slag formers to the steelmaking furnace; introducing carburizers into the steelmaking furnace; heating the charge electrically to melt the charge and form a molten metal bath within the furnace with a molten slag layer on the molten metal bath; maintaining the slag in a foaming condition during the steelmaking process; continuously feeding metallics, slag formers, and carburizers to the furnace; maintaining full electric power to the furnace at all times during the charging, melting and refining operations; and tapping the furnace while continuously feeding the furnace.

OBJECTS OF THE INVENTION

It is the principal object of this invention to provide an apparatus for the continuous operation of an electric steel making furnace.

It is also an object of this invention to provided a means for preheating charge materials to an electric furnace.

It is another object of this invention to provide a continuous electric steelmaking process with good controls over both quality and product chemistry.

It is another object of this invention to provide a method of tapping an electric furnace while maintaing full electric power.

It is another object of this invention to provide a method of operating an electric furnace which will improve the load factor of the furnace and its acceptance as an energy user.

It is also an object of this invention to provide means for continuously melting hot direct reduced iron from a contiguous direct reduction plant.

BRIEF DESCRIPTION OF THE DRAWINGS

The foregoing and other objects will become readily apparent by reference to the following detailed description and the appended drawings, in which.

DETAILED DESCRIPTION

Figure 1:
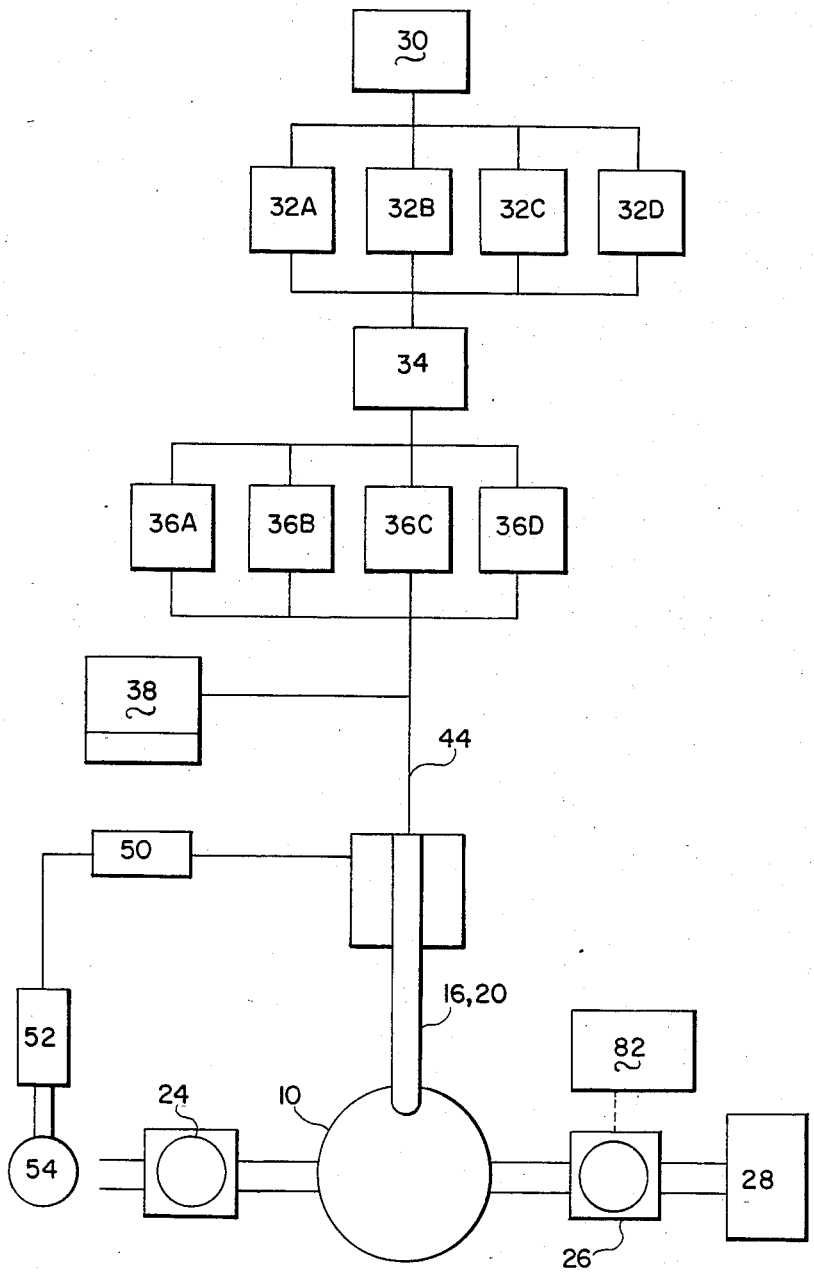
FIG. 1 is a schematic diagram of the steps in the operation of the invented process.
Figure 2:
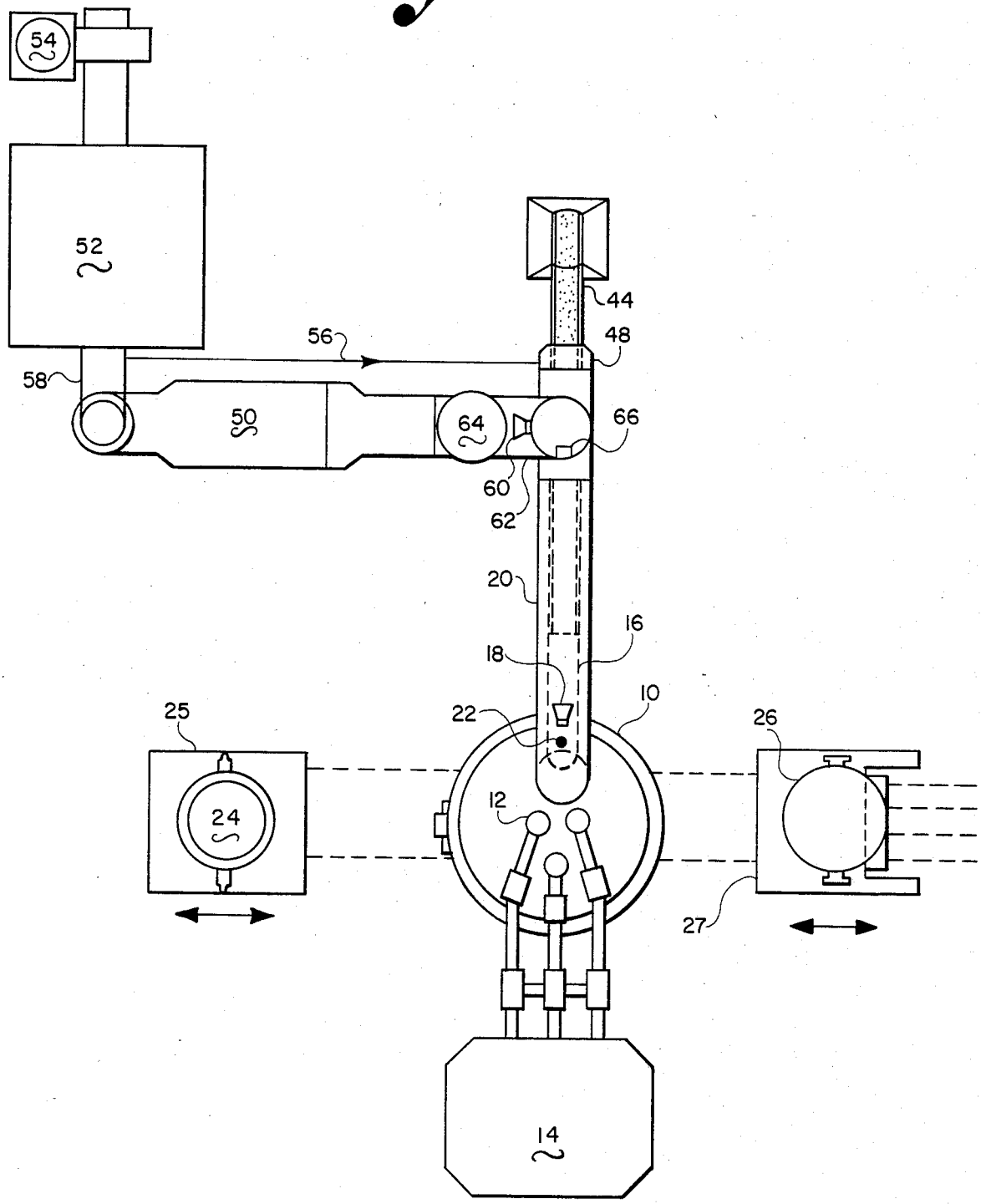
FIG. 2 is a schematic plan view of an electric arc furnace and all associated equipment as described in the present invention.

Referring now to the drawings, an electric arc steelmaking furnace 10 has three electrodes 12 protruding downwardly into the furnace. These electrodes are powered by a transformer (or power source) 14. A chute 16 is provided for introducing charge materials, both metallics and non metallics, into the furnace.

The chute is covered and contains burner 18 for preheating the charge material and burning off combustible matter. The chute is preferably a water-cooled channel and is covered by a segmented refractory tunnel 20 to form a passageway of off-gases from the furnace.

At the exit of the tunnel 20 is located an oxygen sensor 22. For deslagging purposes, a slag pot 24 is provided on a rail-mounted transfer car 25 for moving into and out of slagging position, and for tapping purposes, a steel ladle 26 is also provided on a transfer car 27 for moving into and out of tapping, continuous ladle metallurgy, and pouring positions. The ladle can be teemed directly into a continuous caster 28.

Raw material handling equipment includes scrap receiving station 30, scrap segregation areas or bins 32A, 32B, etc., and a mobile crane for charging raw materials to a shredder or shear 34. The shredder/shear 34 discharges onto a conveyor which transfers the small segrated scrap to corresponding segregated scrap storage areas 36A, 36B, etc. DRI and/or pig iron are stored in area 38. A second crane is provided for charging material from storage areas 36 and 38 onto a conveyor 44. The conveyor enters the tunnel 20 through a dynamic seal 48. Gas handling equipment is connected to the tunnel near the gas seal 48.

The hot off-gas treating system includes a connection to the tunnel, a boiler 50, bag house 52, stack 54, and associated piping. Pipe 56 connecting the gas pipe 58 between the boiler and bag house provides seal gas for the gas seal at the tunnel entrance. A burner 60 is gas passageway 62 heats and melts particulates within the gas which then precipitate into slag pit 64. An oxygen sensor 66 is provided within the gas off-take from the tunnel to determine the fuel-air ratio required by burner 60 for complete combustion of the off-gas.

The furnace 10, although shown as a three phase electric arc furnace, alternatively can be a direct current electric furnace, a plasma furnace or an induction furnace. The preferable type of induction furnace would be the channel induction furnace. Modern electric furnace components should be employed, including an interchangeable crucible or a split shell, water-cooled furnace wall panels and a water-cooled furnace roof.

Heretofore, no tapping practice would allow continuous melting over a continuous 24-hour period. The present invention allows continuous charging and refining with full power to the furnace by tilting the furnace no more than 15° for deslagging and tapping. To allow continuous operation at full power, with the electrodes remaining in contact with the bath, and without damage to the furnace bottom, a molten metal heel is maintained within the bath having approximately the same volume as that of the molten metal removed by each tapping, or each heat. That is, a molten metal heel of approximately 50% of the maximum bath height should be retained after tapping.

Figure 3:
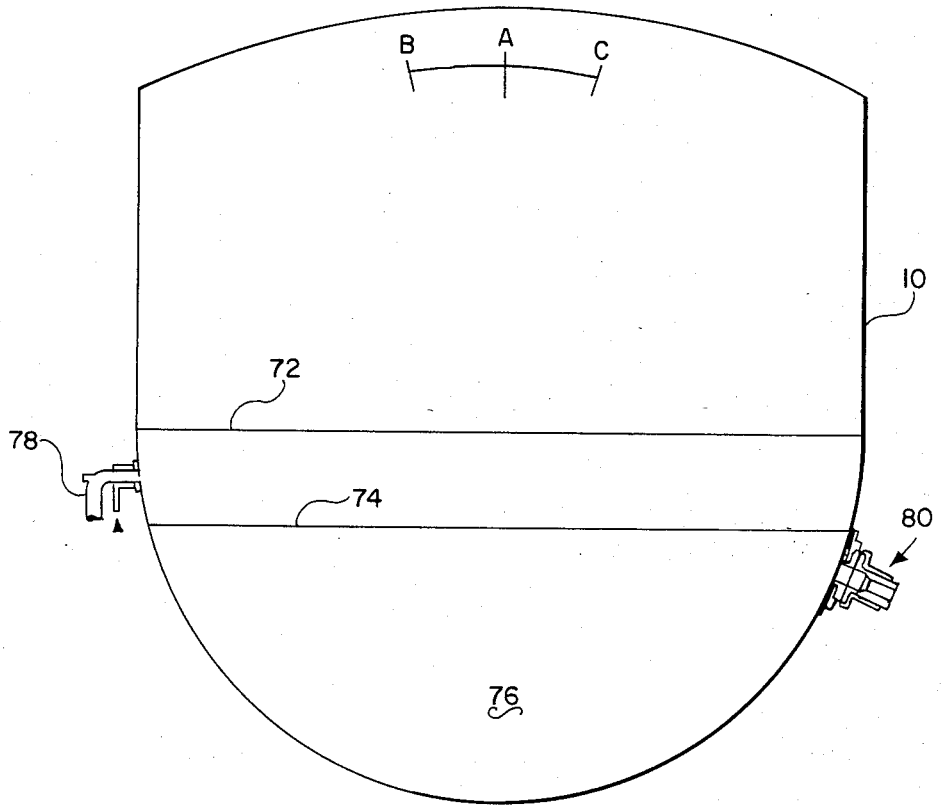
FIG. 3 is a schematic cross-section of an electric arc furnace as described herein.

Steelmaking furnace 10 is shown in FIG. 3. The maximum bath level elevation is indicated by bath line 72 and the minimum elevation of the bath is shown at bath line 74. The molten metal heel 76 constitutes that portion of the bath beneath the minimum bath line 74. One or more underbath tuyeres or blowing nozzles 78 are provided in the furnace beneath the bath line 72. A slideable gate pouring arrangement 80 is also provided in the furnace wall at any desired location beneath the minimum bath line 74. This location prevents the removal of slag from the furnace through the slideable gate pouring arrangement.

The charge feed positions relative to the furnace are indicated at the top of the furnace in FIG. 3. In the normal operating position, charge material is fed at position A. During the tapping operation, the charge material is fed at position B, which represents a 15° tilt of the furnace. Although both the deslagging opening and the tapping opening can be on the same side of the furnace vessel, FIG. 3 shows that the vessel can be tilted in the opposite direction of tapping for slagging, wherein the feeding position would be as indicated at C.

The invented process can employ any of a variety of tapping techniques, including the classic tap-hole, lip pouring, slide gate, and others.

Charge material for continuous melting is ferrous scrap, pig iron and direct reduced iron in pellet or briquet form. Scrap is separated by grades of purity, shredded or sheared to suitable size for continuous feeding into the furnace and stored by grade until required for feeding. Pig iron is granulated or broken into appropriate size for feed stock.

Charge material is selected from the stored shredded or sheared material and other feed stock, weighed and fed onto a conveyor. Preferably, the charge material is weighed on a weighing conveyor. The charge material is preheated in tunnel 20 by passing furnace off-gas through and over it, counter-current to the flow of the charge into the furnace. An oxygen sensor 22 indicates whether the off-gas is sufficiently reducing in character to prevent oxidation of the charge, and controls the adjustment of burners within the tunnel. If necessary, a reducing flame is used in the tunnel. Non-metallic combustible matter in the charge is burned off and the charge is heated to approximately 800° to 1000° C. (1500° to 1830° F.). The burner 18, positioned at the end of chute 20, provides the additional heat necessary to raise the charge temperature to the desired range for introduction to the furnace of 800° to 1000° C. (1500° to 1830° F.).

The steelmaking furnace operates continuously at full power for an extended period of time up to approximately six or seven days during which time no repairs are made to the furnace. After this time the furnace is shut down and the entire crucible or the upper part of the split shell is replaced.

The furnace is operated with a heel of molten metal approximately equal in weight to the tonnage removed at each tapping. This protects the bottom of the furnace from high power input during and immediately after tapping.

The charging, or feed, rate is determined by the desired temperature fluctuation of the bath. As tapping time is approached, the feed rate to the furnace is decreased for a few minutes before tapping. By reducing the chilling effect of the charge on the bath, the bath temperature is increased to the desired tapping temperature.

Slag is kept in the foaming condition during all phases of the process, including the tapping phase, and full power is maintained to the furnace during tapping. Foaming slag is caused by the liberation of CO and $CO_2$ within the slag. The carbon necessary for reaction with the oxygen (oxide) in the charge is injected into the slag or slag-metal interface of the bath in the form of powdered carbon or coke through one or more underbath tuyeres 78 (see FIG. 3). if there is insufficient oxygen present in the bath, oxygen can also be injected through underbath tuyeres to effect the necessary reaction with carbon to promote a foaming slag. Carbon and/or oxygen may be injected into the bath at any time.

Dephosphorization, oxidation, and carburization are carried out within the furnace. However, deoxidation, desulphurization, and alloying are accomplished in the ladle after tapping by a process known as ladle metallurgy, such additions being made from ladle metallurgy area 82. The steel in the ladle is free of molten slag, and alloying elements can be added during the tapping procedure when common steel grades are being produced. Slag formers are added while gas is bubbled through the steel to promote homogeneity and cleanliness.

In order to tap the furnace, it is tilted up to 15° from the normal vertical position. The furnace can be tapped by any desired tapping technique, but it is preferably tapped through a slideable gate controlled pouring hole arrangement. This allows provision for preventing the presence of molten slag in the ladle.

Carbon, lime, oxygen or foamy slag formers may be injected via a replaceable injector nozzle or tuyere 78 beneath the molten metal bath level or into the slag-metal interface.

An example of the operation of the invented process is as follows:

EXAMPLE

The steel enthalpy at a tapping temperature of 1660° C. (3020° F.) is about 347,000 Kcal/metric ton (1.26 million BTU/short ton). By charging 100% scrap, with a normal oxygen consumption of about 10 $Nm^3$ per metric ton (318 scf/short ton), with no burners and no preheating, the electric energy consumption, in an 80 ton/heat furnace, is about 520 Kwh/ton. Additional heat developed within the furnace (due to heat of reaction, electrode oxidation, combustion of combustibles in scrap, etc.) is about 190,000 Kcal/metric ton (655,000 BTU/short ton) or the equivalent of 217 Kwh/metric ton.

Water cooling of the furnace evacuates about 63,000 Kcal/metric ton of steel or 73 Kwh (220,000 BTU or 64 Kwh/short ton) and the slag requires around 60,200 Kcal/metric ton or 70 Kwh (211,300 BTU or 62 Kwh/short ton). Thus, about 160 Kwh or 137,600 Kcal/metric ton (537,000 BTU or 141 Kwh/short ton), are available from the off-gas to preheat the feedstock or charge materials.

The enthalpy of one metric ton of steel scrap at 900° C. (1652° F.) is about 160,200 Kcal or 186 Kwh (562,300 BTU or 164 Kwh/short ton) and the heat transfer efficiency is about 40% for preheating of sheared or shredded scrap. The total heat requirement is then 400,500 Kcal/metric ton (1.4 million BTU/short ton).

The net heat required, taking into account the available heat from the furnace off-gas, is 400,500−137,60=262,900 Kcal/metric ton (923,000 BTU/short ton) or about 31 $Nm^3$ of natural gas per metric ton (975 scf/short ton).

The energy required to melt the preheated charge and superheat the molten metal bath to the tapping temperature of 1660° C. (3020° F.) is 520−(186/0.78)=282 Kwh/metric ton (253 Kwh/short ton).

When hot direct reduced iron is used as the feedstock, natural gas consumption is decreased.

From the foregoing it is clear that I have invented an apparatus for the continuous operation of an electric steelmaking furnace, with means for preheating charge materials, charging and tapping while maintaining full electric power, and having good control over both quality and product chemistry.

What is claimed is:

1. Apparatus for the continuous refining of steel comprising:

an electric arc steelmaking furnace for melting and refining a metallic charge therein;

electrodes extending into said furnace a distance beneath the slag level of a molten metal bath to be contained therein;

feed means communicating with said furnace for introducing charge materials to the interior of said furnace;

means communicating with said feed means for preheating charge materials within said feed means;

gas seal means for providing a controlled atmosphere within said feed means;

gas injection means communicating with said furnace beneath the normal molten metal bath level; and means for tilting said furnace up to 15° from the vertical without removing said electrodes, for the purposes of slagging and tapping.

2. Apparatus for the continuous production of molten steel from direct reduced iron, comprising:

a source of hot direct reduced iron;

an electric arc steelmaking furnace for melting and refining a metallic charge therein;

electrodes extending into said furnace a distance beneath the slag level of a molten metal bath to be contained therein;

feed means communicating with said furnace for introducing direct reduced iron and other charge materials to the interior of said furnace;

means communicating with said feed means for preheating charge materials within said feed means;

gas seal means for providing a controlled atmosphere within said feed means;

gas injection means communicating with said furnace beneath the normal molten metal bath level;

means for tilting said furnace up to 15° from the vertical without removing said electrodes, for the purposes of slagging and tapping;

a track mounted ladle adapted for receiving molten steel upon each tap of said furnace; and a ladle metallurgy station adapted for communication with said ladle.

3. Apparatus according to claim 1 wherein said feed means is a chute.

4. Apparatus according to claim 3 wherein said chute is a water-cooled channel.

5. Apparatus according to claim 3 wherein said chute is enclosed in a refractory tunnel.

6. Apparatus according to claim 1 further comprising tapping means in said furnace beneath the elevation of the melt.

7. Apparatus according to claim 6 wherein said tapping means is a tap-hole.

8. Apparatus according to claim 6 wherein said tapping means is a slide gate.

9. Apparatus according to claim 2 wherein said feed means is a chute.

10. Apparatus according to claim 9 wherein said chute is a water-cooled channel.

11. Apparatus according to claim 9 wherein said chute is enclosed in a refractory tunnel.

12. Apparatus according to claim 2 further comprising tapping means in said furnace beneath the elevation of the melt.

13. Apparatus according to claim 12 wherein said tapping means is a tap-hole.

14. Apparatus according to claim 12 wherein said tapping means is a slide gate.

* * * * *